US009523964B2

(12) United States Patent
Zhang

(10) Patent No.: US 9,523,964 B2
(45) Date of Patent: Dec. 20, 2016

(54) INTELLIGENT WRISTWATCH

(71) Applicant: Shenzhen China Star Optoelectronics Technology Co., Ltd., Shenzhen, Guangdong (CN)

(72) Inventor: Yanxue Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 14/436,402

(22) PCT Filed: Dec. 18, 2014

(86) PCT No.: PCT/CN2014/094237
§ 371 (c)(1),
(2) Date: Apr. 16, 2015

(87) PCT Pub. No.: WO2016/090668
PCT Pub. Date: Jun. 16, 2016

(65) Prior Publication Data

US 2016/0170379 A1 Jun. 16, 2016

(30) Foreign Application Priority Data

Dec. 11, 2014 (CN) ..... 2014 1 0764557

(51) Int. Cl.
*G04B 25/00* (2006.01)
*G04B 19/00* (2006.01)
(Continued)

(52) U.S. Cl.
CPC ..... *G04G 17/045* (2013.01); *G04B 45/00* (2013.01); *G04C 17/0091* (2013.01); *G04G 9/00* (2013.01);
(Continued)

(58) Field of Classification Search
CPC ..... G04B 45/00; G04G 9/00; G04G 9/0029; G04G 9/0064; G04G 99/006; G04C 17/0091
(Continued)

(56) References Cited

U.S. PATENT DOCUMENTS 4,444,513 A * 4/1984 Proellochs ..... G04B 37/0427 368/223
6,158,884 A * 12/2000 Lebby ..... G04B 47/00 224/165
(Continued)

*Primary Examiner* — Amy Cohen Johnson
*Assistant Examiner* — Daniel Wicklund
(74) *Attorney, Agent, or Firm* — Andrew C. Cheng

(57) ABSTRACT

Disclosed is a dial plate of an intelligent wristwatch, which includes a body, a first screen, a second screen, and a third screen. The first screen is rotatably connected to the body by a first rotary axle. The second screen is rotatably connected to the body by a second rotary axle. The third screen is rotatably connected to the body by a third rotary axle. The second rotary axle and the third rotary axle are opposite to and parallel to each other. The first rotary axle is perpendicular to the second rotary axle. Vertical distances of the first rotary axle, the second rotary axle, and the third rotary axle from the body are reduced in sequence so that the first screen, the second screen, and the third screen are allowed to overlap each other on the body. Also disclosed is an intelligent wristwatch having an expandable display screen.

12 Claims, 4 Drawing Sheets

(51) Int. Cl.

| | |
|---|---|
| ***G04C 17/00*** | (2006.01) |
| ***G04C 19/00*** | (2006.01) |
| ***G04C 19/02*** | (2006.01) |
| ***G04C 17/02*** | (2006.01) |
| ***G04G 17/04*** | (2006.01) |
| ***G04G 9/00*** | (2006.01) |
| ***G04B 45/00*** | (2006.01) |
| ***G04G 99/00*** | (2010.01) |

(52) U.S. Cl.
CPC ..... *G04G 9/0029* (2013.01); *G04G 9/0064* (2013.01); *G04G 99/006* (2013.01)

(58) Field of Classification Search
USPC ..... 368/223–225, 239–242
See application file for complete search history.

(56) References Cited

U.S. PATENT DOCUMENTS 6,567,523 B1 * 5/2003 Ghassabian ..... H04B 1/385 379/433.1
6,859,219 B1 * 2/2005 Sall ..... G06F 1/1607 345/1.1
7,091,926 B2 * 8/2006 Kulas ..... G06F 3/1446 345/1.1
7,556,384 B2 * 7/2009 Chan ..... A45D 42/18 353/122
8,477,567 B2 * 7/2013 Greubel ..... G04B 19/025 368/220
8,606,340 B2 * 12/2013 Pegg ..... H04M 1/0247 455/575.4
8,613,061 B2 * 12/2013 Dvorak ..... G06F 1/1647 380/282
2002/0021622 A1 * 2/2002 Baroche ..... G04B 37/0016 368/10
2002/0135535 A1 * 9/2002 Muller ..... G06F 1/1616 345/1.1
2003/0133515 A1 * 7/2003 Kondo ..... G06F 1/1616 375/295
2005/0134524 A1 * 6/2005 Parker ..... G06F 3/1438 345/1.1
2009/0219788 A1 * 9/2009 Henley, Jr. ..... G04G 17/083 368/13
2014/0233356 A1 * 8/2014 Pattikonda ..... G04G 9/0064 368/13
2014/0239065 A1 * 8/2014 Zhou ..... G06F 1/163 235/380

* cited by examiner

INTELLIGENT WRISTWATCH

CROSS REFERENCE TO RELATED APPLICATIONS

This application claims the priority of Chinese Patent Application No. 201410764557.2, entitled "Intelligent Wristwatch", filed on Dec. 11, 2014, the disclosure of which is incorporated herein by reference in its entirety.

BACKGROUND OF THE INVENTION

1. Field of the Invention

The present invention relates to wearable intelligent product, and in particular to an intelligent wristwatch.

2. The Related Arts

With the fast progress of the communication devices and Pad like products, the development and application of wearable intelligent devices are getting wider and wider. Conventional intelligent wrist watches generally have sizes that are less than 2 inches. If the size of a screen is excessively large, then the outside appearance of the entire device would seem very bulky. However, if the surface area of the screen is excessively small, making the functionality of the device severely constrained, various operation functions may be available, severely lowering down the functionality of the intelligent wrist watch.

SUMMARY OF THE INVENTION

The present invention provides a dial plate of an intelligent wristwatch and an intelligent wristwatch that overcome the problem that a screen of an intelligent wristwatch is small and thus causing constraints to product functionality and allows for expansion of a displaying screen of the intelligent wristwatch.

To achieve the above object, the present invention provides the following technical solutions:

In an aspect, the present invention provides a dial plate of an intelligent wristwatch, which comprises a body, a first screen, a second screen, and a third screen. The first screen is rotatably connected to the body by a first rotary axle. The second screen is rotatably connected to the body by a second rotary axle. The third screen is rotatably connected to the body by a third rotary axle. The second rotary axle and the third rotary axle are opposite to and parallel to each other. The first rotary axle is perpendicular to the second rotary axle. Vertical distances of the first rotary axle, the second rotary axle, and the third rotary axle from the body are reduced in sequence so that the first screen, the second screen, and the third screen are allowed to overlap each other on the body.

In the above dial plate, the body has a surface on which a first side plate and a second side plate are arranged to protrude therefrom. The first side plate and the second side plate are opposite to and parallel to each other. The first side plate and the second side plate have bottoms connected to the body. The first side plate and the second side plate have tops distant from the body. The first rotary axle is mounted to the top of the first side plate. The second rotary axle and the third rotary axle are each connected between the first side plate and the second side plate in such a way that the second rotary axle is close to the tops of the first side plate and the second side plate and the third rotary axle is close to the bottoms of the first side plate and the second side plate.

In the above dial plate, the top of the first side plate has two ends each provided with a mounting peg protruding therefrom. The first rotary axle is rotatably connected between the two mounting pegs. The tops of the first side plate and the second side plate carry and support thereon the first screen.

In the above dial plate, the first rotary axle and the two mounting pegs comprise an elastic element arranged therebetween so that elastic connection of the elastic element between the first rotary axle and the two mounting pegs allows the first screen to stay stable without being affected by an external force.

In the above dial plate, the first screen, the second screen, and the third screen are sequentially expandable with respect to the body and the first screen is re-closable so as to allow the first screen, the second screen, and the third screen to collectively form an expanded screen. The dial plate of the intelligent wristwatch comprises therein a control module. The control module functions to control collaborative operations of the first screen, the second screen, and the third screen.

In another aspect, the present invention provides an intelligent wristwatch, which comprises a bracelet and a dial plate connected to the bracelet, wherein the dial plate comprises a body, a first screen, a second screen, and a third screen. The first screen is rotatably connected to the body by a first rotary axle. The second screen is rotatably connected to the body by a second rotary axle. The third screen is rotatably connected to the body by a third rotary axle. The second rotary axle and the third rotary axle are opposite to and parallel to each other. The first rotary axle is perpendicular to the second rotary axle. Vertical distances of the first rotary axle, the second rotary axle, and the third rotary axle from the body are reduced in sequence so that the first screen, the second screen, and the third screen are allowed to overlap each other on the body.

In the above intelligent wristwatch, the body has a surface on which a first side plate and a second side plate are arranged to protrude therefrom. The first side plate and the second side plate are opposite to and parallel to each other. The first side plate and the second side plate have bottoms connected to the body. The first side plate and the second side plate have tops distant from the body. The first rotary axle is mounted to the top of the first side plate. The second rotary axle and the third rotary axle are each connected between the first side plate and the second side plate in such a way that the second rotary axle is close to the tops of the first side plate and the second side plate and the third rotary axle is close to the bottoms of the first side plate and the second side plate.

In the above intelligent wristwatch, the top of the first side plate has two ends each provided with a mounting peg protruding therefrom. The first rotary axle is rotatably connected between the two mounting pegs. The tops of the first side plate and the second side plate carry and support thereon the first screen.

In the above intelligent wristwatch, the first rotary axle and the two mounting pegs comprise an elastic element arranged therebetween so that elastic connection of the elastic element between the first rotary axle and the two mounting pegs allows the first screen to stay stable without being affected by an external force.

In the above intelligent wristwatch, the first screen, the second screen, and the third screen are sequentially expandable with respect to the body and the first screen is re-closable so as to allow the first screen, the second screen, and the third screen to collectively form an expanded screen. The dial plate of the intelligent wristwatch comprises therein a control module. The control module functions to control collaborative operations of the first screen, the second screen, and the third screen.

The present invention provides a first screen, a second screen, and a third screen that are rotatably connected to a body of a dial plate so as to allow the first screen, the second screen, and the third screen to be expandable with respect to the body and combined with each other to form an expanded screen for increasing a screen displaying area thereby allowing for expansion of the functionality of an intelligent wristwatch. When the intelligent wristwatch is in a non-working condition, the first screen, the second screen, and the third screen can be overlapped on the body, making the size reduced for easy carrying.

BRIEF DESCRIPTION OF THE DRAWINGS

To more clearly illustrate the technical solutions proposed in the present invention, a brief description of the drawings that are necessary for describing embodiments of the present invention is given below. It is obvious that the drawings that will be described below show only some embodiments of the present invention and for those having ordinary skills of the art, other drawings may also be readily available from these attached drawings without the expense of creative effort and endeavor.

DETAILED DESCRIPTION OF THE PREFERRED EMBODIMENTS

A clear and complete description will be given to technical solutions of the embodiments of the present invention with reference to the attached drawings of the embodiments of the present invention.

Figure 1:
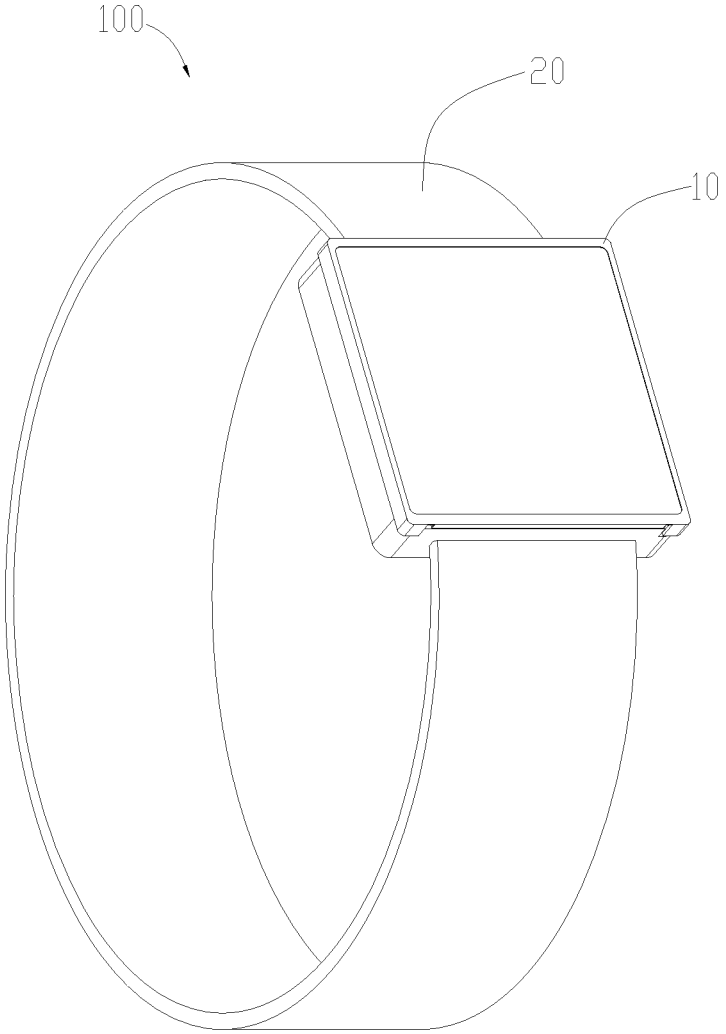
FIG. 1 is a schematic view illustrating an intelligent wristwatch according to an embodiment of the present invention with a first screen, a second screen, and a third screen being in an overlapped closed condition.
Figure 2:
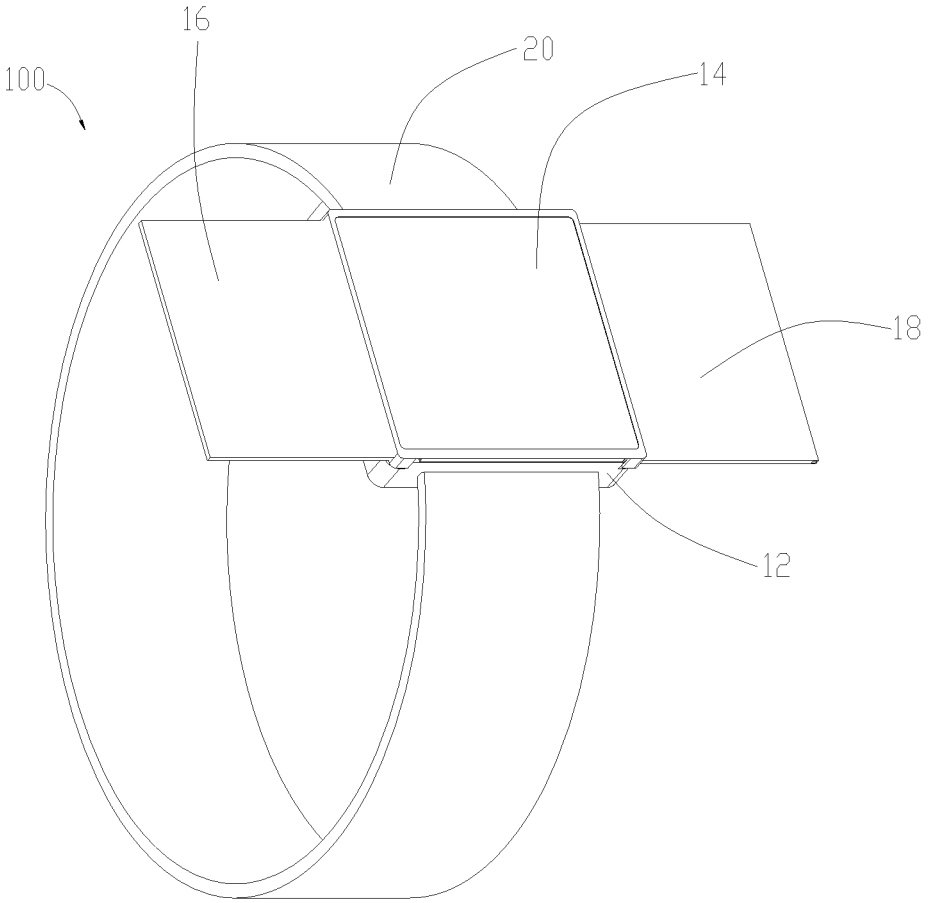
FIG. 2 is a schematic view illustrating the intelligent wristwatch according to the embodiment of the present invention with the first screen, the second screen, and the third screen being in an expanded condition.
Figure 3:
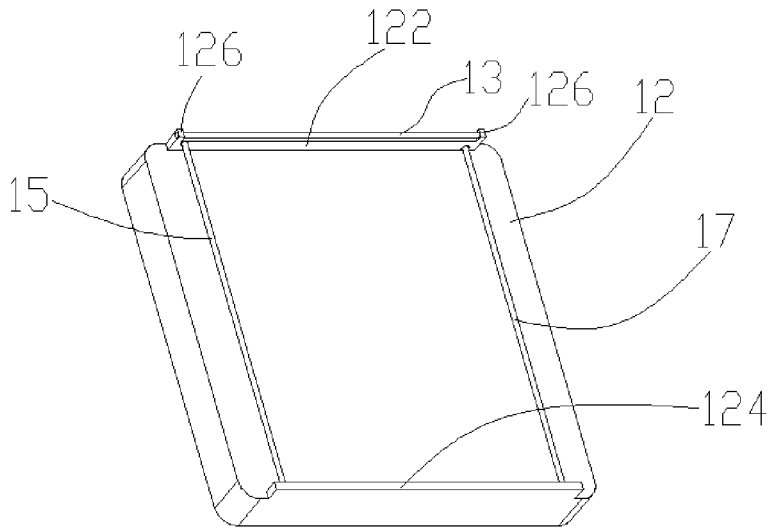
FIG. 3 is a schematic view illustrating a body of a dial plate of the intelligent wristwatch according to the present invention.

Referring to FIGS. 1 and 2, the present invention provides an intelligent wristwatch 100 and a dial plate 10 of the intelligent wristwatch. The intelligent wristwatch 100 comprises a bracelet 20 and the dial plate 10 that is connected to the bracelet 20. The dial plate 10 comprises a body 12, a first screen 14, a second screen 16, and a third screen 18. Referring to FIG. 3, the first screen 14 is rotatably connected to the body 12 by the first rotary axle 13; the second screen 16 is rotatably connected to the body 12 by the second rotary axle 15; and the third screen 18 is rotatably connected to the body 12 by the third rotary axle 17.

Figure 4:
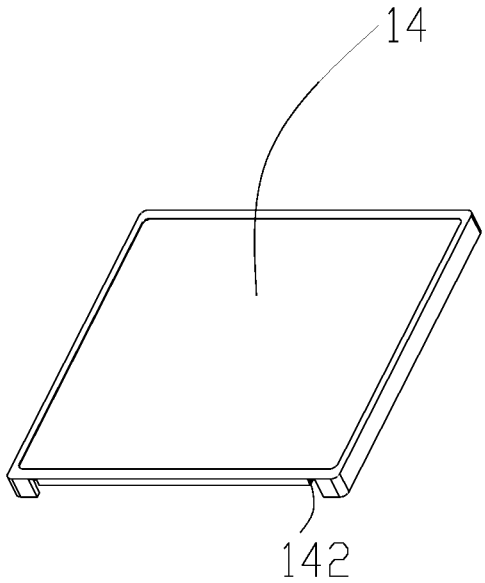
FIG. 4 is a schematic view illustrating the first screen of the dial plate of the intelligent wristwatch according to the present invention.
Figure 5:
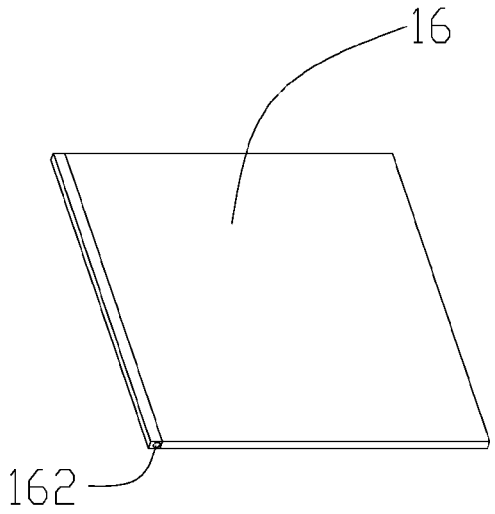
FIG. 5 is a schematic view illustrating the second screen of the dial plate of the intelligent wristwatch according to the present invention.

In the instant embodiment, the first screen 14, the second screen 16, and the third screen 18 are all of a rectangular shape. Referring to FIGS. 4 and 5, the rotatable connection of the first screen 14 with the first rotary axle 13 is set at one edge portion of the first screen 14, wherein one of the edge portions of the first screen 14 is provided with an axle hole 142 formed therein and the first rotary axle 13 is arranged in combination with the axle hole 142 to achieve the rotatable connection. Connections of the second screen 16 and the third screen 18 with the rotary axles thereof are similar to that of the first screen 14, being both set at edge portions, wherein the edge portion of the second screen 16 is provided with an axle hole 162 to allow for mating combination of the second rotary axle 15 with the axle hole 162 of the second screen 16 to achieve the rotatable connection.

The second rotary axle 15 and the third rotary axle 17 are opposite to and parallel to each other. The first rotary axle 13 is perpendicular to the second rotary axle 15 and the first rotary axle 13 extends between the second rotary axle 15 and the third rotary axle 17. Further, the first rotary axle 13 is located at one end of the second rotary axle 15 and the third rotary axle 17 so the three axles collectively define a U-shape. Vertical distances of the first rotary axle 13, the second rotary axle 15, and the third rotary axle 17 from the body 12 are reduced in sequence. In other words, the vertical distance between the third rotary axle 17 and the body 12 is shortest; the vertical distance between the first rotary axle 13 and the body 12 is the longest; and the vertical location of the second rotary axle 15 is between the first rotary axle 13 and the third rotary axle 17. This allows the first screen 14, the second screen 16, and the third screen 18 to be arranged on the body 12 in a mutually overlapping manner.

The present invention provides a first screen 14, a second screen 16, and a third screen 18 that are rotatably connected to a body 12 of a dial plate 10 so as to allow the first screen 14, the second screen 16, and the third screen 18 to be expandable with respect to the body 12 and combined with each other to form an expanded screen for increasing a screen displaying area thereby allowing for expansion of the functionality of an intelligent wristwatch 100. When the intelligent wristwatch 100 is in a non-working condition, the first screen 14, the second screen 16, and the third screen 18 can be overlapped on the body 12, making the size reduced for easy carrying.

Specifically, referring to FIG. 3, the body 12 has a surface on which a first side plate 122 and a second side plate 124 are arranged to protrude therefrom. The first side plate 122 and the second side plate 124 are arranged opposite to and spaced from each other. The first side plate 122 and the second side plate 124 have bottoms connected to the body 12 so that tops of the first side plate 122 and the second side plate 124 are distant from the body 12. The first rotary axle 13 is mounted to the top of the first side plate 122. The second rotary axle 15 and the third rotary axle 17 are each connected between the first side plate 122 and the second side plate 124 in such a way that the second rotary axle 15 is close to the tops of the first side plate 122 and the second side plate 124 and the third rotary axle 17 is close to the bottoms of the first side plate 122 and the second side plate 124. The first side plate 122 and the second side plate 124 collectively define therebetween a receiving space, so that the second screen 16 and the third screen 18, when not expanded, are receivable in the receiving space.

Figure 6:
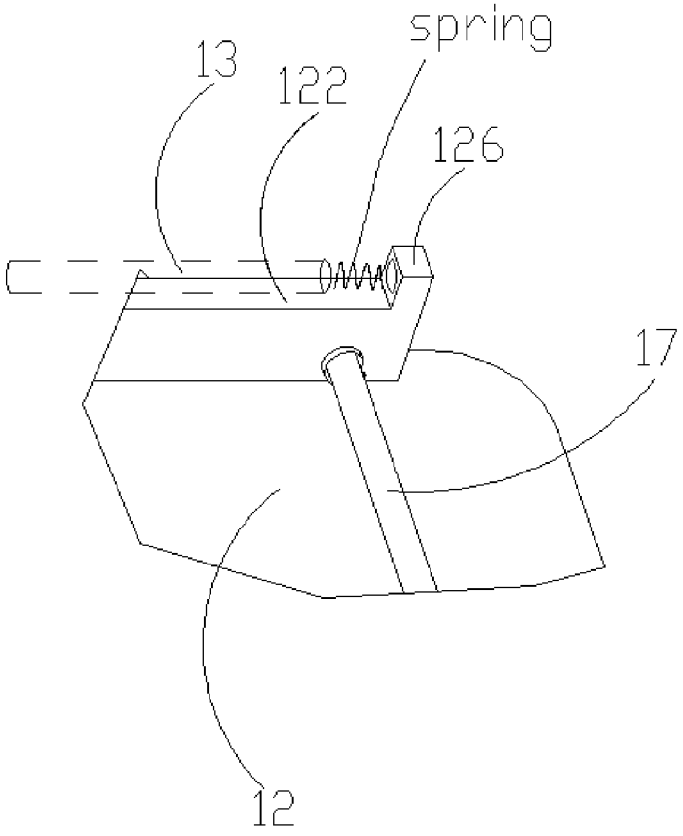
FIG. 6 is a schematic view, in an enlarged form, illustrating a portion of the body of the dial plate of the intelligent wristwatch according to the present invention.

In the instant embodiment, as shown in FIG. 6, opposite ends of the top of the first side plate 122 are each provided with a mounting peg 126 protruding therefrom. The first rotary axle 13 is rotatably coupled between the two mounting pegs 126. The tops of the first side plate 122 and the second side plate 124 carry and support the first screen 14 thereon.

Elastic elements (not shown) are arranged between the first rotary axle 13 and the two mounting pegs 126. The elastic elements can be springs. Through elastic connection of the elastic elements between the first rotary axle 13 and the two mounting pegs 126, the first screen 14 is kept stable without being affected by external forces. In other words, the elastic elements provide elastic support forces between the first rotary axle 13 and the mounting pegs 126 to allow the first screen 14 to stay in a stable condition without being affected by external forces to unexpectedly open and expand and expanding the first screen 14 can only be achieved by overcoming the elastic forces of the elastic elements. The second screen 16 and the third screen 18 are arranged between the first screen 14 and the body 12 so that there is no need to provide elastic elements at the sites of the rotary axles thereof. This is because in the closed condition illustrated in FIG. 1, the first screen 14 is kept positioned stably so as to ensure the stable positioning of the second screen 16 and the third screen 18. Further, in an expanded condition illustrated in FIG. 2, an edge of each of the second screen 16 and the third screen 18 is located under the first screen 14 so that the stable positioning of the first screen 14 also ensures the stable positioning of the second screen 16 and the third screen 18.

The first screen 14, the second screen 16, and the third screen 18 are expandable with respect to the body 12 in sequence and then, the first screen 14 is re-closed to allow the first screen 14, the second screen 16, and the third screen 18 collectively form an expanded screen. The dial plate 10 of the intelligent wristwatch is provided therein with a control module (not shown) and the control module is used to control the collaborative operations of the first screen 14, the second screen 16, and the third screen 18. In other words, the first screen 14, the second screen 16, and the third screen 18 after being expanded, may be viewed as a single screen for operations.

Disclosed above are only the preferred embodiments of the present invention. It is appreciated that those having ordinary skills of the art may readily appreciate various improvements and modifications without departing from the principle of the present invention and these improvements and modifications are considered within the protection scope of the present invention.

What is claimed is:

1. An intelligent wristwatch dial plate, comprising a body, a first screen, a second screen, and a third screen, the first screen being rotatably connected to the body by a first rotary axle, the second screen being rotatably connected to the body by a second rotary axle, the third screen being rotatably connected to the body by a third rotary axle, the second rotary axle and the third rotary axle being mounted to the body in an immobile manner to be opposite to and parallel to each other, the first rotary axle being mounted to the body in an immobile manner and substantially perpendicular to the second rotary axle and the third rotary axle, vertical distances of the first rotary axle, the second rotary axle, and the third rotary axle from the body being reduced step by step so that the first screen, the second screen, and the third screen are allowed to overlap each other on the body;

wherein the first screen is rotatable between a first closed position where the first screen is positioned substantially flat on the body and a first open position where the first screen is rotated away from the body; the second screen is rotatable between a second closed position where the second screen is positioned substantially flat on the body and a second open position where the second screen is rotated away from the body and located on a first one of two opposite sides of the body to be substantially flush with the body; and the third screen is rotatable between a third closed position where the third screen is positioned substantially flat on the body and a third open position where the third screen is rotated away from the body and located on a second one of two opposite sides of the body to be substantially flush with the body, such that the first, second, and third screens are switchable between a folded condition where the second and third screens are respectively at the second and third closed positions, and the first screen is at the first closed position and located above the second and third screens and an expanded condition where the second and third screens are respectively at the second and third open positions and located on the two opposite sides of the body substantially flush with the body, and the first screen is at the first closed position and positioned substantially flat on the body, allowing the first, second, and third screens substantially flush with each other with the first screen located between the second and third screens; and wherein an elastic element is mounted between the first screen and the body and applies an elastic force to the first screen to bias the first screen toward the first closed position.

2. The intelligent wristwatch dial plate as claimed in claim 1, wherein the body has a surface on which a first side plate and a second side plate are arranged to protrude therefrom, the first side plate and the second side plate being opposite to and parallel to each other, the first side plate and the second side plate having bottoms connected to the body, the first side plate and the second side plate having tops distant from the body, the first rotary axle being mounted to the top of the first side plate, the second rotary axle and the third rotary axle being each connected between the first side plate and the second side plate in such a way that the second rotary axle is close to the tops of the first side plate and the second side plate and the third rotary axle is close to the bottoms of the first side plate and the second side plate.

3. The intelligent wristwatch dial plate as claimed in claim 2, wherein the top of the first side plate has two ends each provided with a mounting peg protruding therefrom, the first rotary axle being rotatably connected between the two mounting pegs, the tops of the first side plate and the second side plate carrying and supporting thereon the first screen.

4. The intelligent wristwatch dial plate as claimed in claim 3, wherein the elastic element is coupled between the first rotary axle of the first screen and one of the two mounting pegs of the first side plate of the body so that the elastic force of the elastic element between the first rotary axle and the two mounting pegs biases the first screen to the first closed position and thus allows the first screen to stay stable without being affected by an external force.

5. The intelligent wristwatch dial plate as claimed in claim 1, wherein the first screen, the second screen, and the third screen are sequentially expandable with respect to the body by moving from the first, second, and third closed positions to the first, second, and third open positions and the first screen is re-closable back to the first closed position so as to allow the first screen, the second screen, and the third screen be respectively located on the body and at the two opposite sides of the body and substantially flush with each other to collectively form an expanded screen, the dial plate of the intelligent wristwatch comprising therein a control module, the control module functioning to control collaborative operations of the first screen, the second screen, and the third screen.

6. The intelligent wristwatch dial plate as claimed in claim 1, wherein the elastic element comprises a spring.

7. An intelligent wristwatch, comprising a bracelet and a dial plate connected to the bracelet, wherein the dial plate comprises a body, a first screen, a second screen, and a third screen, the first screen being rotatably connected to the body by a first rotary axle, the second screen being rotatably connected to the body by a second rotary axle, the third screen being rotatably connected to the body by a third rotary axle, the second rotary axle and the third rotary axle being opposite to and parallel to each other, the first rotary axle being perpendicular to the second rotary axle, vertical distances of the first rotary axle, the second rotary axle, and the third rotary axle from the body being reduced step by step so that the first screen, the second screen, and the third screen are allowed to overlap each other on the body;

wherein the first screen is rotatable between a first closed position where the first screen is positioned substantially flat on the body and a first open position where the first screen is rotated away from the body; the second screen is rotatable between a second closed position where the second screen is positioned substantially flat on the body and a second open position where the second screen is rotated away from the body and located on a first one of two opposite sides of the body to be substantially flush with the body; and the third screen is rotatable between a third closed position where the third screen is positioned substantially flat on the body and a third open position where the third screen is rotated away from the body and located on a second one of two opposite sides of the body to be substantially flush with the body, such that the first, second, and third screens are switchable between a folded condition where the second and third screens are respectively at the second and third closed positions, and the first screen is at the first closed position and located above the second and third screens and an expanded condition where the second and third screens are respectively at the second and third open positions and located on the two opposite sides of the body substantially flush with the body, and the first screen is at the first closed position and positioned substantially flat on the body, allowing the first, second, and third screens substantially flush with each other with the first screen located between the second and third screens; and wherein an elastic element is mounted between the first screen and the body and applies an elastic force to the first screen to bias the first screen toward the first closed position.

8. The intelligent wristwatch as claimed in claim 7, wherein the body has a surface on which a first side plate and a second side plate are arranged to protrude therefrom, the first side plate and the second side plate being opposite to and parallel to each other, the first side plate and the second side plate having bottoms connected to the body, the first side plate and the second side plate having tops distant from the body, the first rotary axle being mounted to the top of the first side plate, the second rotary axle and the third rotary axle being each connected between the first side plate and the second side plate in such a way that the second rotary axle is close to the tops of the first side plate and the second side plate and the third rotary axle is close to the bottoms of the first side plate and the second side plate.

9. The intelligent wristwatch as claimed in claim 8, wherein the top of the first side plate has two ends each provided with a mounting peg protruding therefrom, the first rotary axle being rotatably connected between the two mounting pegs, the tops of the first side plate and the second side plate carrying and supporting thereon the first screen.

10. The intelligent wristwatch as claimed in claim 9, wherein the elastic element is coupled between the first rotary axle of the first screen and one of the two mounting pegs of the first side plate of the body so that the elastic force of the elastic element between the first rotary axle and the two mounting pegs biases the first screen to the first closed position and thus allows the first screen to stay stable without being affected by an external force.

11. The intelligent wristwatch as claimed in claim 7, wherein the first screen, the second screen, and the third screen are sequentially expandable with respect to the body by moving from the first, second, and third closed positions to the first, second, and third open position and the first screen is re-closable back to the first closed positions so as to allow the first screen, the second screen, and the third screen be respectively located on the body and at the two opposite sides of the body and substantially flush with each other to collectively form an expanded screen, the dial plate of the intelligent wristwatch comprising therein a control module, the control module functioning to control collaborative operations of the first screen, the second screen, and the third screen.

12. The intelligent wristwatch as claimed in claim 7, wherein the elastic element comprises a spring.

* * * * *